US006112686A

United States Patent [19]

Tsumiyama et al.

[11] Patent Number: 6,112,686

[45] Date of Patent: Sep. 5, 2000

[54] STORAGE STRUCTURE FOR PERSONAL WATERCRAFT

[75] Inventors: Yoshinori Tsumiyama, Miki; Kenichi Nakagawa, Kobe, both of Japan; Kiyoaki Maeda; Kunihiko Kamio, both of Irvine, Calif.; Joe Heim, Orange, Calif.; William Peter Engle, Jr., Costa Mesa, Calif.; Gary Bozych, Lake Forest, Calif.

[73] Assignee: Kawasaki Jukogyo Kabushiki Kaisha, Kobe, Japan

[21] Appl. No.: 09/350,679

[22] Filed: Jul. 12, 1999

[30] Foreign Application Priority Data

Jul. 15, 1998 [JP] Japan ..... 10-200699

[51] Int. Cl.[7] ..... B63C 7/00

[52] U.S. Cl. ..... 114/55.53

[58] Field of Search ..... 114/55.5, 55.53, 114/78, 361, 343

[56] References Cited

U.S. PATENT DOCUMENTS 4,998,966 3/1991 Yamaguchi ..... 114/270

5,894,810 4/1999 Orr ..... 114/343

FOREIGN PATENT DOCUMENTS 6-227484 8/1994 Japan .

6-270883 9/1994 Japan .

6-305479 11/1994 Japan .

6-312684 11/1994 Japan .

7-45428 2/1995 Japan .

8-207887 8/1996 Japan .

10-7080 1/1998 Japan .

*Primary Examiner*—S. Joseph Morano

*Assistant Examiner*—Patrick Craig Muldoon

*Attorney, Agent, or Firm*—Oliff & Berridge, PLC

[57] ABSTRACT

In the storage structure for a personal watercraft, a first hatch cover is installed in front of a handlebar in an openable and closable fashion with respect to a deck and a second hatch cover is installed on the first hatch cover in an openable and closable fashion with respect to the first hatch cover. A first storage area is formed inside the first hatch cover and a second storage area is formed inside the second hatch cover.

6 Claims, 9 Drawing Sheets

STORAGE STRUCTURE FOR PERSONAL WATERCRAFT

BACKGROUND OF THE INVENTION

1. Field of Invention

The invention relates to a personal watercraft (also called a PWC) that planes along the surface of the water, and more particularly, to a storage structure for the personal watercraft.

2. Description of Related Art

Personal watercraft have been gaining popularity in recent years for sports and recreational purposes. Generally, the personal watercraft is constructed to move forward by increasing the pressure of water drawn through a water intake, provided on a bottom of the body of the watercraft, by a propulsion pump and ejecting the water rearward from the body. The size of personal watercraft has been increasing in recent years, with the development of three-seater craft as well as single-seater and two-seater ones, and a storage area size has been increasing correspondingly.

Storage areas are formed, for example, behind the seat of the personal watercraft and between the seat and the handlebar, and also in front of the handlebar. The storage area in front of the handlebar is formed so that it is exposed when, for example, the hatch cover mounted swingably in front of the handlebar is opened.

Articles to be stored in this storage area include relatively large size items, such as a cooler box and a collapsible beach parasol, and relatively small size items, such as gloves and goggles. Since the storage area is increasing in size so that it can accommodate a large size article, such as a cooler box, the hatch cover that covers the storage area is also increasing in size. Further, the storage area is located in a relatively low position. The prior art relating to this type of storage area includes the storage area disclosed in the Publication of Examined Japanese Utility Model Applications No. 7-45428.

In the prior art, therefore, the rider has to dismount from the watercraft to load or unload an article into or from the storage area.

SUMMARY OF THE INVENTION

In consideration of above-mentioned circumstances, it is an object of the invention to provide a storage structure for a personal watercraft that enables the watercraft rider to load and unload articles into and from the storage area while the rider remains on board the watercraft.

The invention provides a storage structure for a personal watercraft having a handlebar for steering in front of a seat. A first hatch cover is installed in front of the handlebar in an openable and closable fashion with respect to a deck of the personal watercraft and a second hatch cover is installed on the first hatch cover in an openable and closable fashion with respect to the first hatch cover. A first storage area is formed inside the first hatch cover and a second storage area is formed inside the second hatch cover.

According to the storage structure for the personal watercraft described above, the watercraft rider can access the second storage area by just opening the second hatch cover without having to open the first hatch cover. The rider can access the second storage area while he remains on board the personal watercraft. Since the second storage area is formed in a limited space above the first hatch cover, its size cannot be made very large but is enough to provide a space to accommodate relatively small size articles, for example, such as gloves and goggles. The second storage area is thus suitable for storing small articles that the rider may often want to take out while he remains on board the personal watercraft.

It is preferable that a forward end of the first hatch cover is supported near a forward end of the deck so that the first hatch cover is swingable with respect to the deck, and that a forward end of the second hatch cover is supported near the forward end of the first hatch cover so that the second hatch cover is swingable with respect to the first hatch cover. With this structure, the second storage area can be made as large as possible by making maximum use of the limited space above the first hatch cover.

It is also preferable to form a recessed portion in the upper surface of the first hatch cover or a pocket inside the second hatch cover so that articles stored in the second storage area will not move around therein while the personal watercraft is running.

Furthermore, when a recessed portion is formed in the upper surface of the first hatch cover and a pocket capable of being accommodated within the recessed portion is formed inside the second hatch cover in such a manner that the open end of the pocket is closed by a wall surface of the recessed portion when the second hatch cover is closed, the wall surface of the recessed portion can be made to serve as the lid of the pocket, eliminating the need for the provision of a large lid member.

BRIEF DESCRIPTION OF THE DRAWINGS

These and other aspects and advantages of the invention will become apparent from the following detailed description of preferred embodiments when taken in conjunction with the accompanying drawings, in which.

DETAILED DESCRIPTION OF PREFERRED EMBODIMENTS

Figure 1:
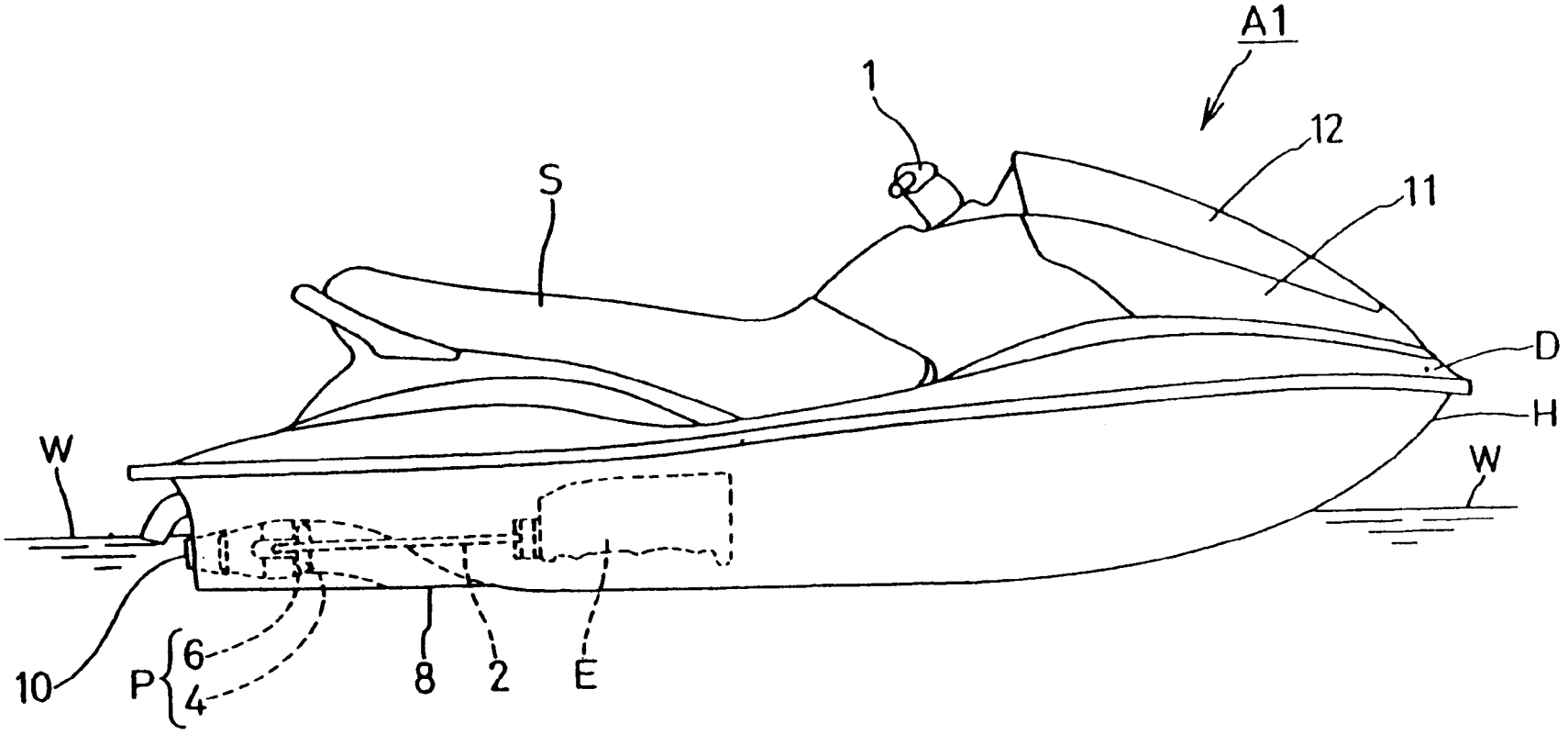
FIG. 1 is a side view showing a personal watercraft employing a storage structure according to a preferred embodiment of the invention.

For a general understanding of the features of the invention, reference is made to the drawings. In the drawings, like reference numerals have been used throughout to designate like elements.

Figure 2:
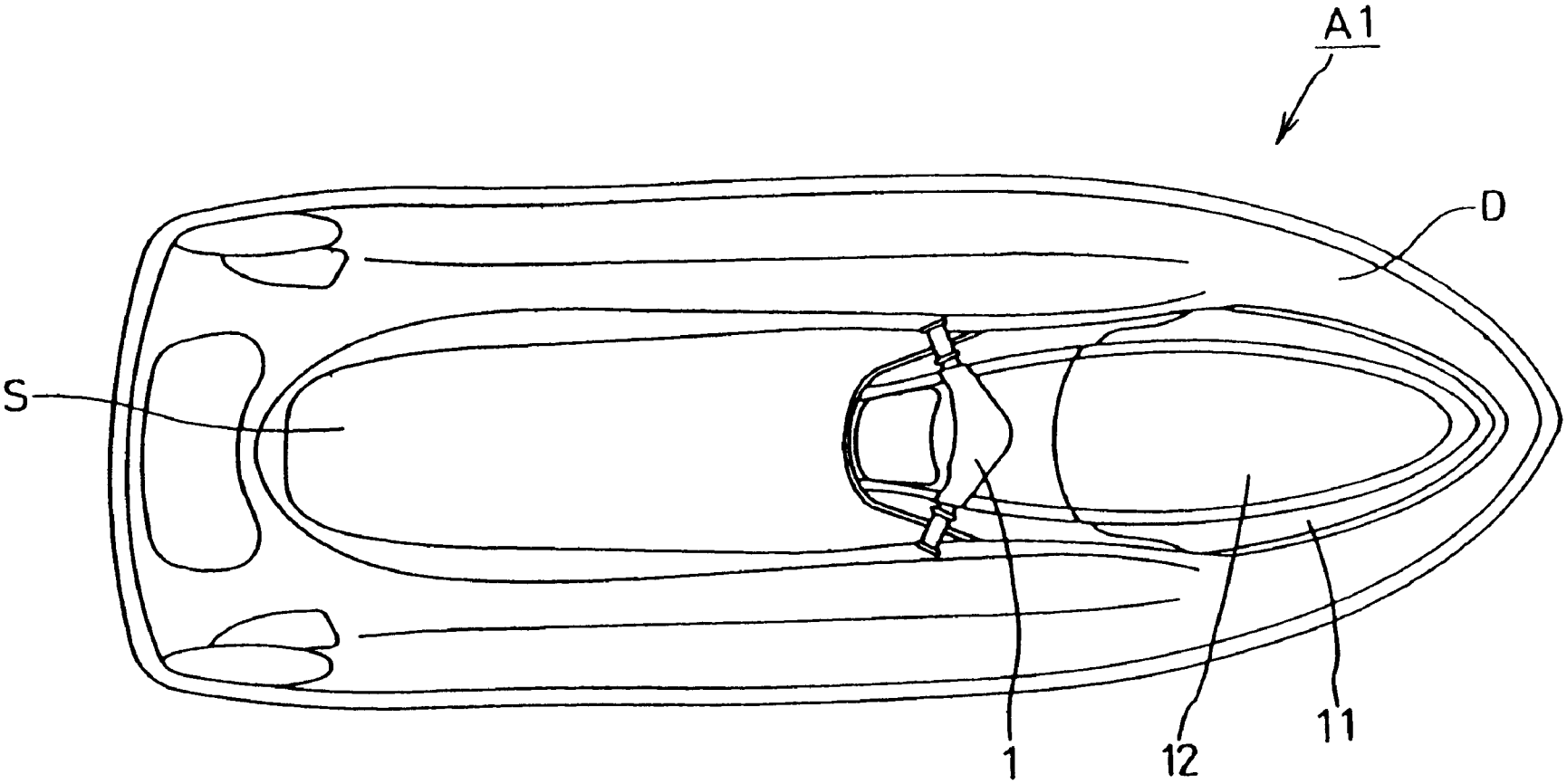
FIG. 2 is a plan view showing the personal watercraft of FIG. 1.

FIG. 1 is a side view showing a personal watercraft A1 employing a storage structure according to a preferred embodiment of the invention, and FIG. 2 is a plan view of the same. In FIGS. 1 and 2, the personal watercraft A1 is shown floating on the water W indicates the surface of the water.

An outer shell of a body of the personal watercraft A1 includes a hull H made of fiberglass reinforced plastic (FRP) and a deck D made of fiberglass reinforced plastic (FRP) covering an upper side of the hull H. The personal watercraft A1 is equipped with an engine E as a power source, and the rotation of the engine E is transmitted to an impeller 4 via a drive shaft (rotation shaft) 2. The impeller 4, together with a casing 6 provided around the outer circumference thereof, constitutes a propulsion pump P. The personal watercraft A1 is constructed in such a manner that the water drawn through a water intake 8 provided on the bottom of the hull is pressurized by the propulsion pump P and ejected rearward through a jet nozzle (not shown) at the rear, thereby producing propulsive force. The jet nozzle is covered by a steering nozzle 10 located further rearward.

The mounting position of the engine varies depending on the type of the personal watercraft. In the personal watercraft A1 according to this embodiment, the engine E is mounted beneath a seat S. In other words, the seat S is located above an engine room where the engine E is accommodated. A handlebar 1 for steering is mounted in front of the seat S. When the handlebar 1 is steered to the right or left, the steering nozzle 10 swings to the right or left so that the personal watercraft A1 can be steered in the desired direction. A reverse deflector (not shown) which is turnable downward about a horizontal support shaft is provided above the steering nozzle 10 and further rearward. By turning the deflector to a position rearward of the steering nozzle 10 and thereby causing the water expelled rearward from the steering nozzle 10 to turn toward the front, the personal watercraft A1 can be moved in the reverse direction.

The portion of the deck D forward of the handlebar 1 is covered with a first hatch cover 11. A second hatch cover 12 is mounted on the first hatch cover 11. These hatch covers 11 and 12 can be opened and closed.

Figure 3:
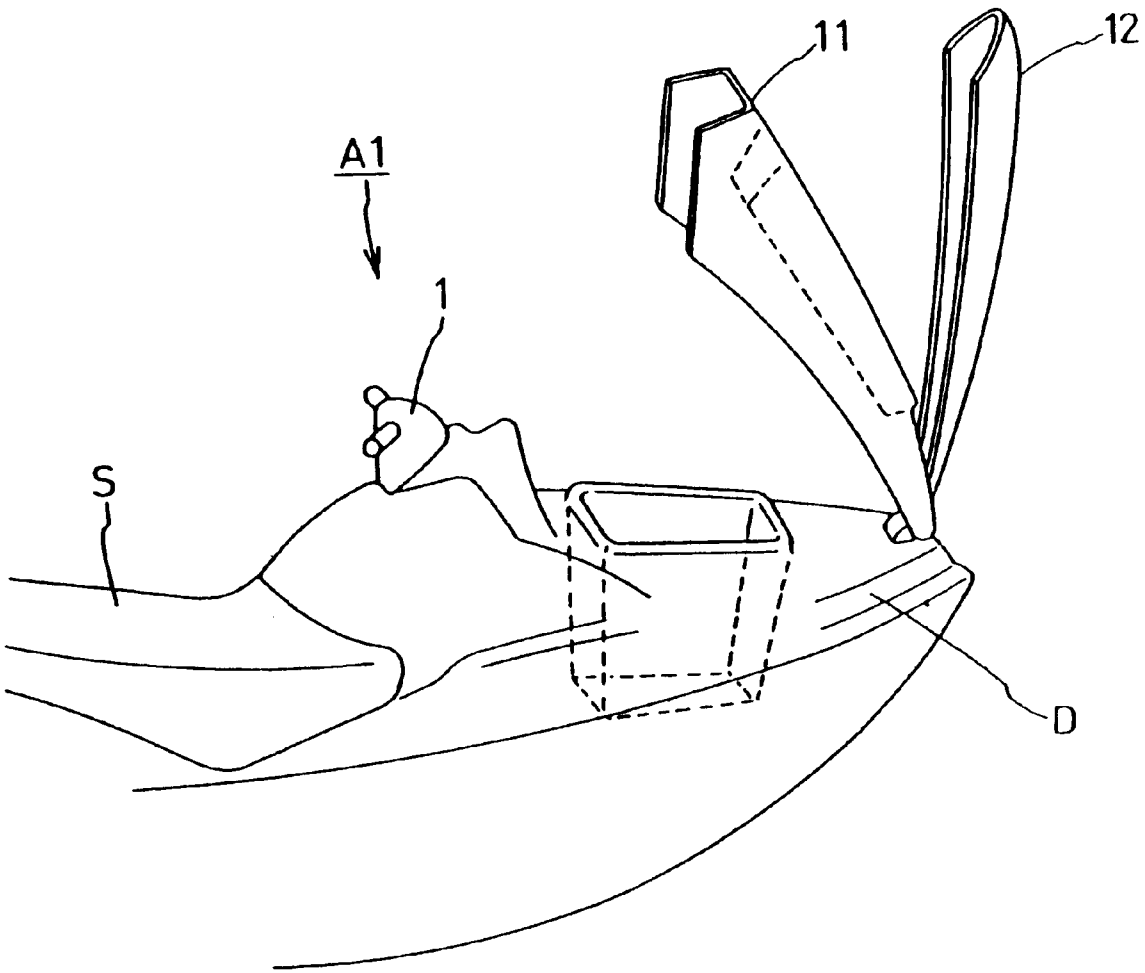
FIG. 3 is a perspective view showing the front half portion of the personal watercraft according to the invention with a first hatch cover and a second hatch cover opened.

FIG. 3 is a perspective view showing the front half portion of the personal watercraft A1 with the first and second hatch covers 11 and 12 opened. In an actual operating condition of the personal watercraft A1, there seldom occurs the case where both the hatch covers 11 and 12 are opened at the same time as shown here, but FIG. 3 provides the view to facilitate the understanding of the construction of the two hatch covers 11 and 12 and their inside structure. A lock mechanism (not shown) for locking the first hatch cover 11 in its closed condition may be interposed between the first hatch cover 11 and the deck D, and a lock mechanism (not shown) for locking the second hatch cover 12 in its closed condition may be interposed between the second hatch cover 12 and the deck D. These lock mechanisms are similar in construction to a lock mechanism employed on the trunk of a passenger car, and are remotely controlled using operating devices (not shown) provided near the handlebar 1.

Figure 4:
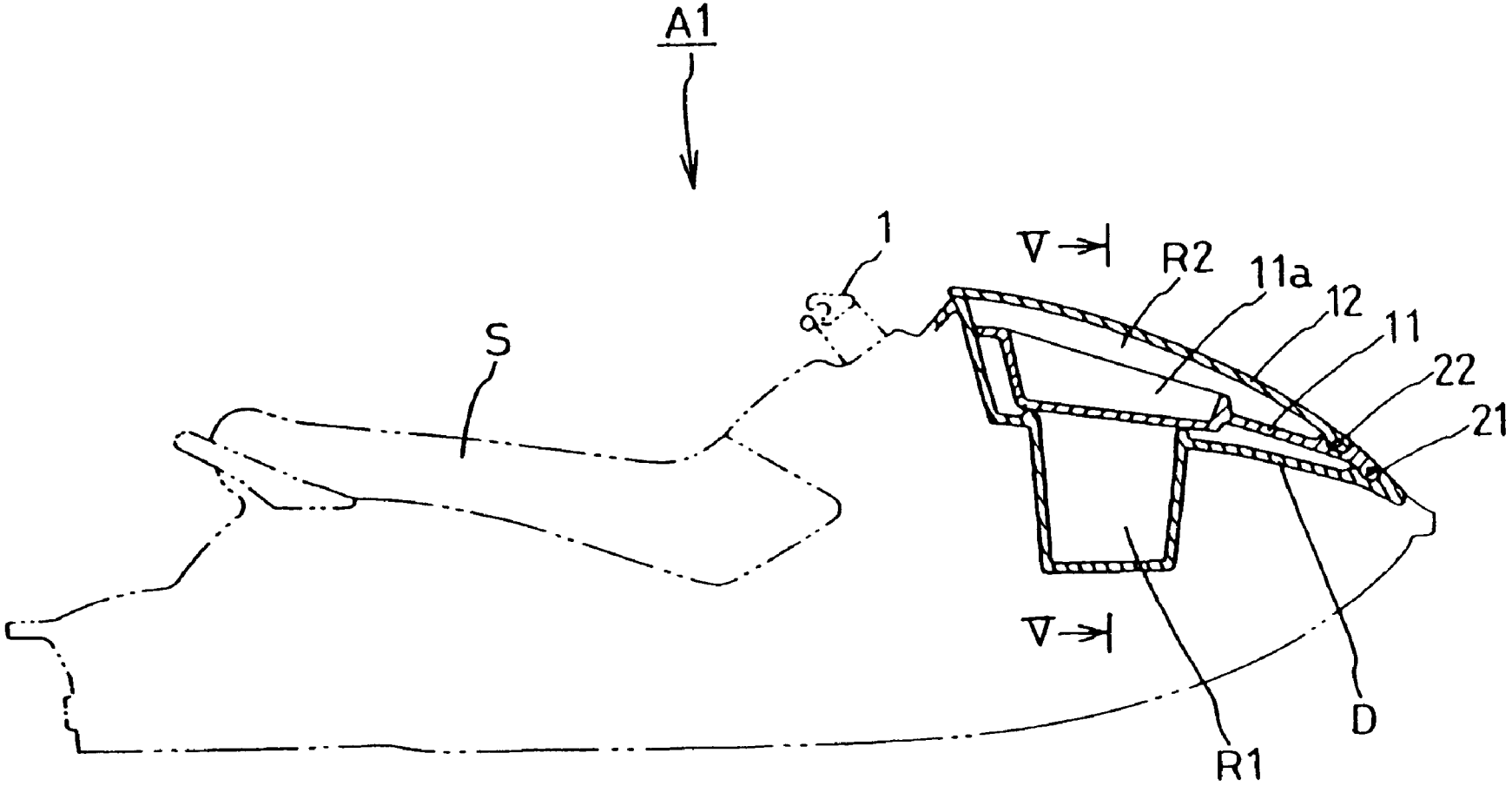
FIG. 4 is a cross sectional view of the front half portion of the deck and the first and second hatch covers, together with the contour lines of the personal watercraft as viewed from one side thereof.
Figure 5:
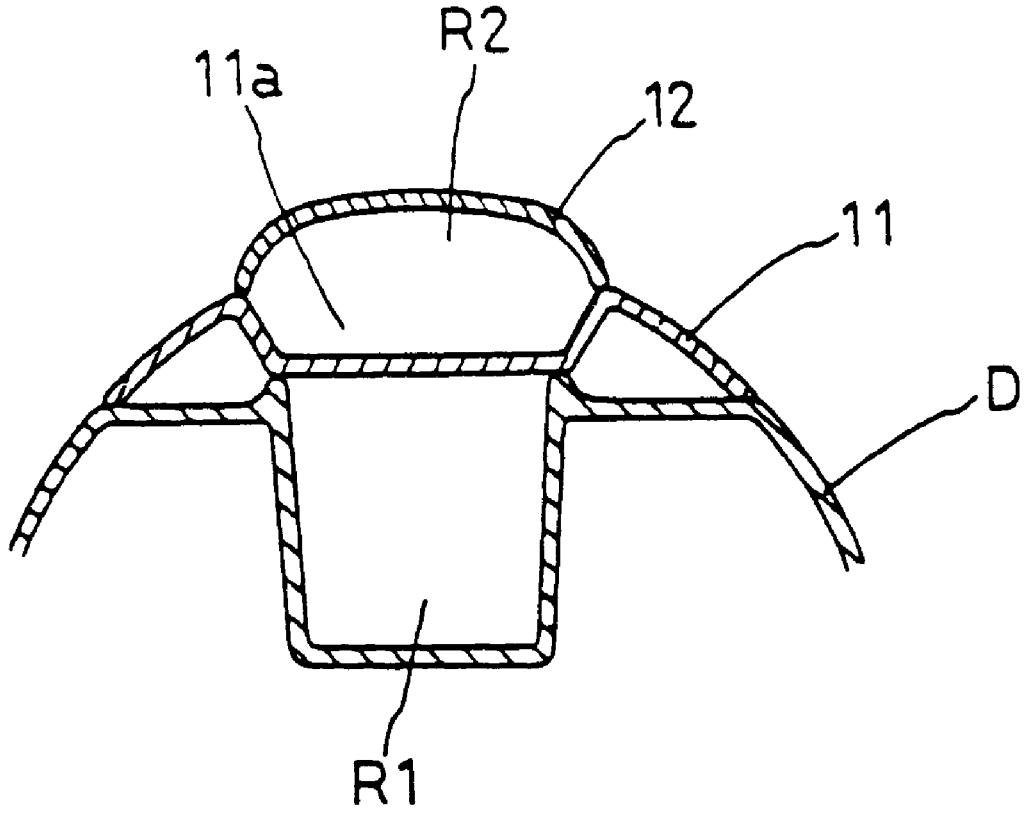
FIG. 5 is a cross sectional view taken along line V—V of FIG. 4.

FIG. 4 is a cross sectional view of the front half portion of the deck D and the first and second hatch covers 11 and 12, together with the contour lines of the personal watercraft A1 as viewed from one side thereof. FIG. 5 is a cross sectional view taken along line V—V of FIG. 4.

In FIG. 4, the front end of the first hatch cover 11 is attached adjacent to the front end portion of the deck D by means of a rotating shaft 21 (hereinafter simply referred to as "shaft"). That is, the first hatch cover 11 is supported swingably at the shaft 21 so that the first hatch cover 11 can be opened and closed on the deck D by being turned about the shaft 21. Inside the first hatch cover 11 is formed a first storage area R1. More specifically, the recessed portion R1 is formed in the upper surface of the deck D, and this recessed portion R1 serves as the first storage area R1. The open end of the first storage area R1 is closed by the first hatch cover 11, as shown in FIGS. 4 and 5. The first storage area R1 is accessible by opening the first hatch cover 11.

Figure 6:
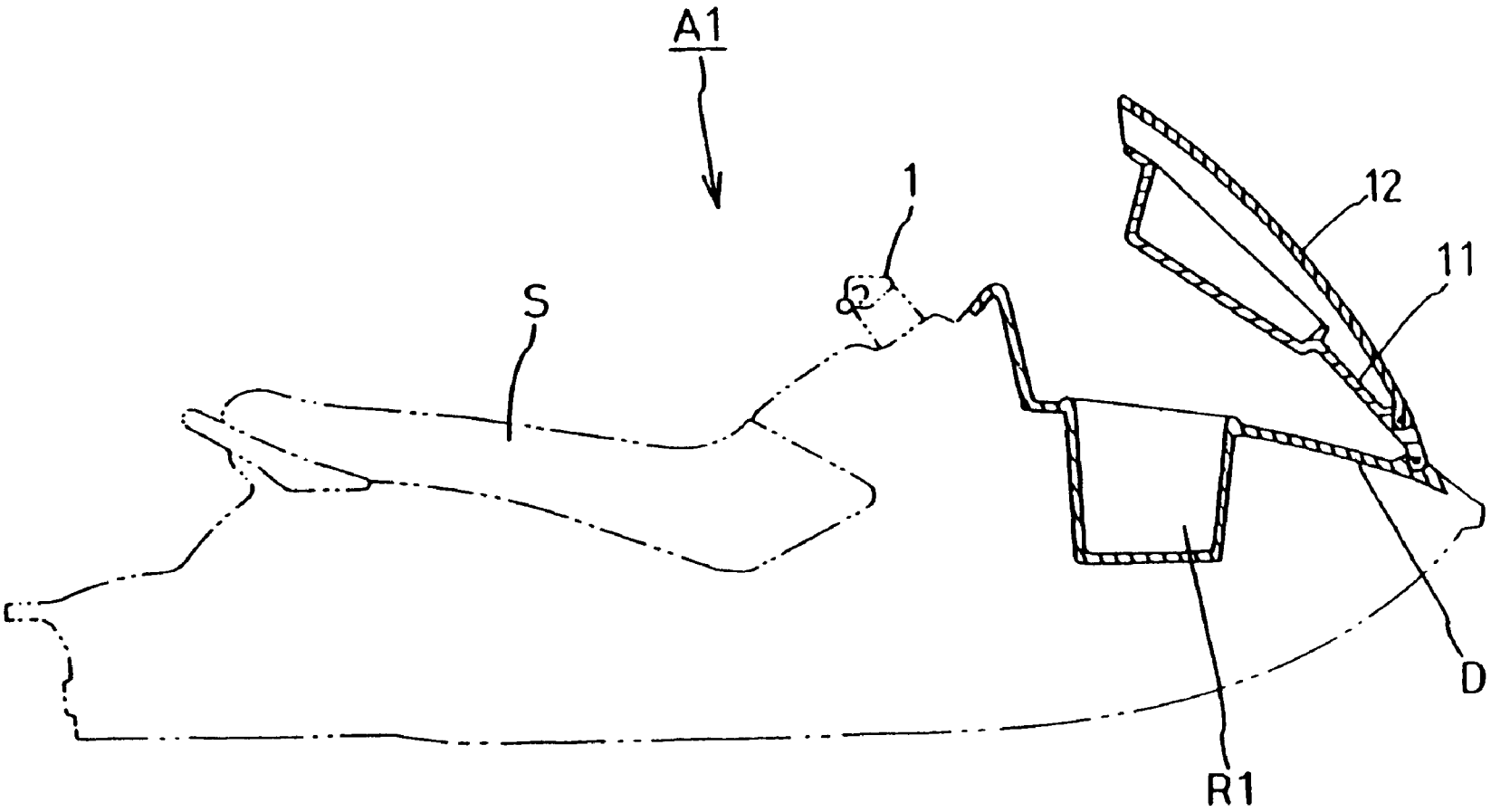
FIG. 6 is a cross sectional view showing the first hatch cover in an opened condition.

FIG. 6 is a cross sectional view showing the first hatch cover 11 in an opened condition. When the first hatch cover 11 is opened, as shown, the first storage area R1 is exposed. The first storage area R1 can be used to store infrequently used articles, such as, for example, a collapsible beach parasol, that the watercraft rider will seldom need to unload while he remains on board the personal watercraft A1.

Referring again to FIGS. 4 and 5, the front end of the second hatch cover 12 is attached adjacent to the front end portion of the first hatch cover 11 by means of a rotating shaft 22 (hereinafter simply referred to as the "shaft"). That is, the second hatch cover 12 is supported swingably at the shaft 22 so that the second hatch cover 12 can be opened and closed on the first hatch cover 11 by being turned about the shaft 22. Inside the second hatch cover 12 is formed a second storage area R2. More specifically, the space enclosed by the first hatch cover 11 and the second hatch cover 12 serves as the second storage area R2. In the personal watercraft A1 of this embodiment, the front end of the first hatch cover 11 extends nearly to the front end of the deck D, and the front end of the second hatch cover 12 extends nearly to the front end of the first hatch cover 11, which means that the second storage area R2 is formed as large as possible. The second storage area R2 is accessible by opening the second hatch cover 12.

A recessed portion 11*a* of a shape suitable for accommodating articles is formed in the upper surface of the first hatch cover 11. The recessed portion 11*a* is so formed to prevent articles contained therein from moving around when the personal watercraft A1 is running.

Figure 7:
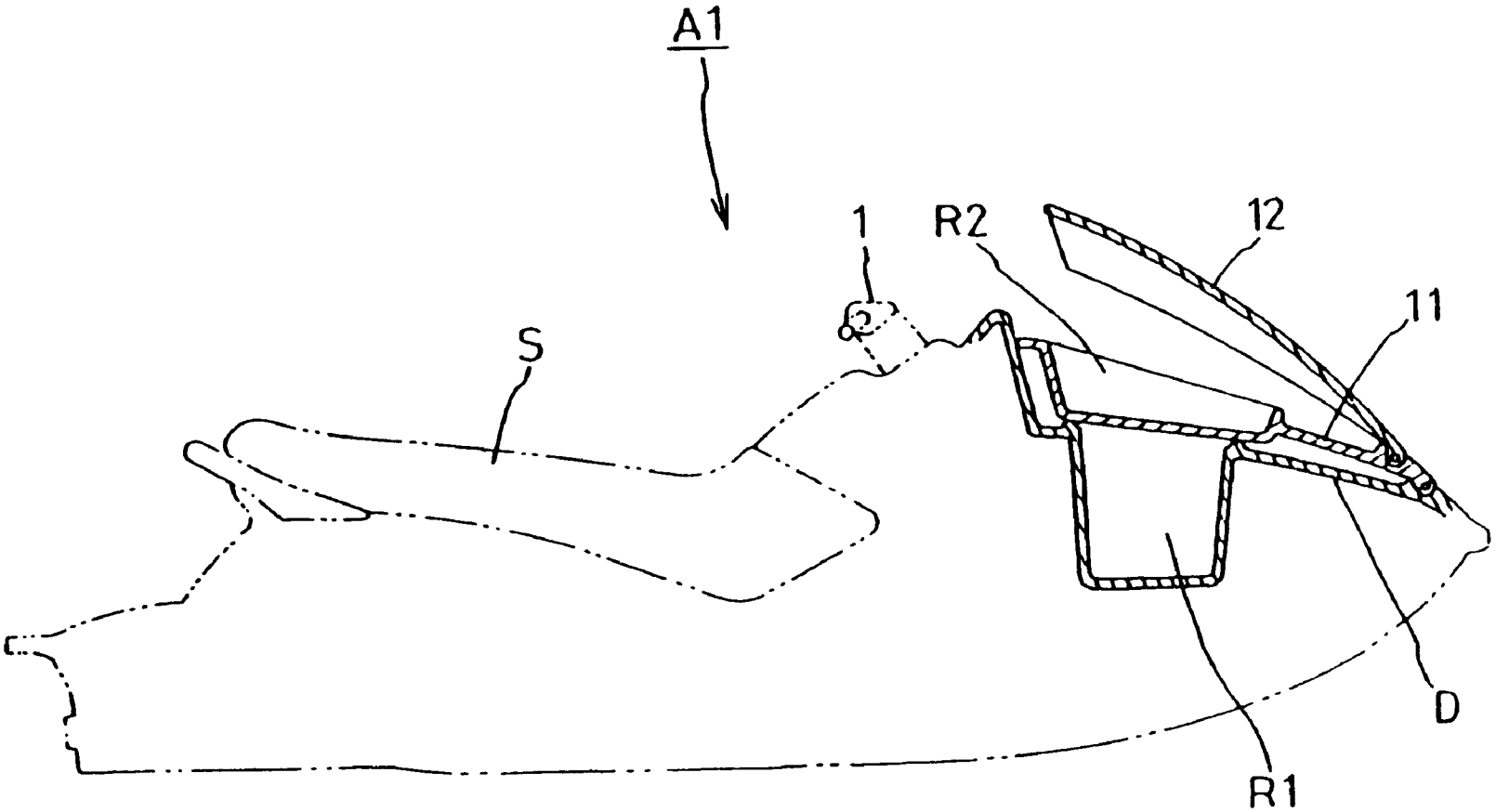
FIG. 7 is a cross sectional view showing the second hatch cover in an opened condition.

FIG. 7 is a cross sectional view showing the second hatch cover 12 in an opened condition. When the second hatch cover 12 is opened, as shown, the second storage area R2 is exposed. The second storage area R2 may be used to store frequently used articles, such as, for example, gloves and goggles, that the watercraft rider may often want to take out while he remains on board the personal watercraft A1. As can be seen from FIG. 7, the second storage area R2 is located in a relatively high position so that the rider can reach into it while he is on board the personal watercraft A1. Furthermore, since the second storage area R2 can be accessed by just opening the second hatch cover 12, the rider can load and unload articles while he remains on board the personal watercraft A1.

Figure 8:
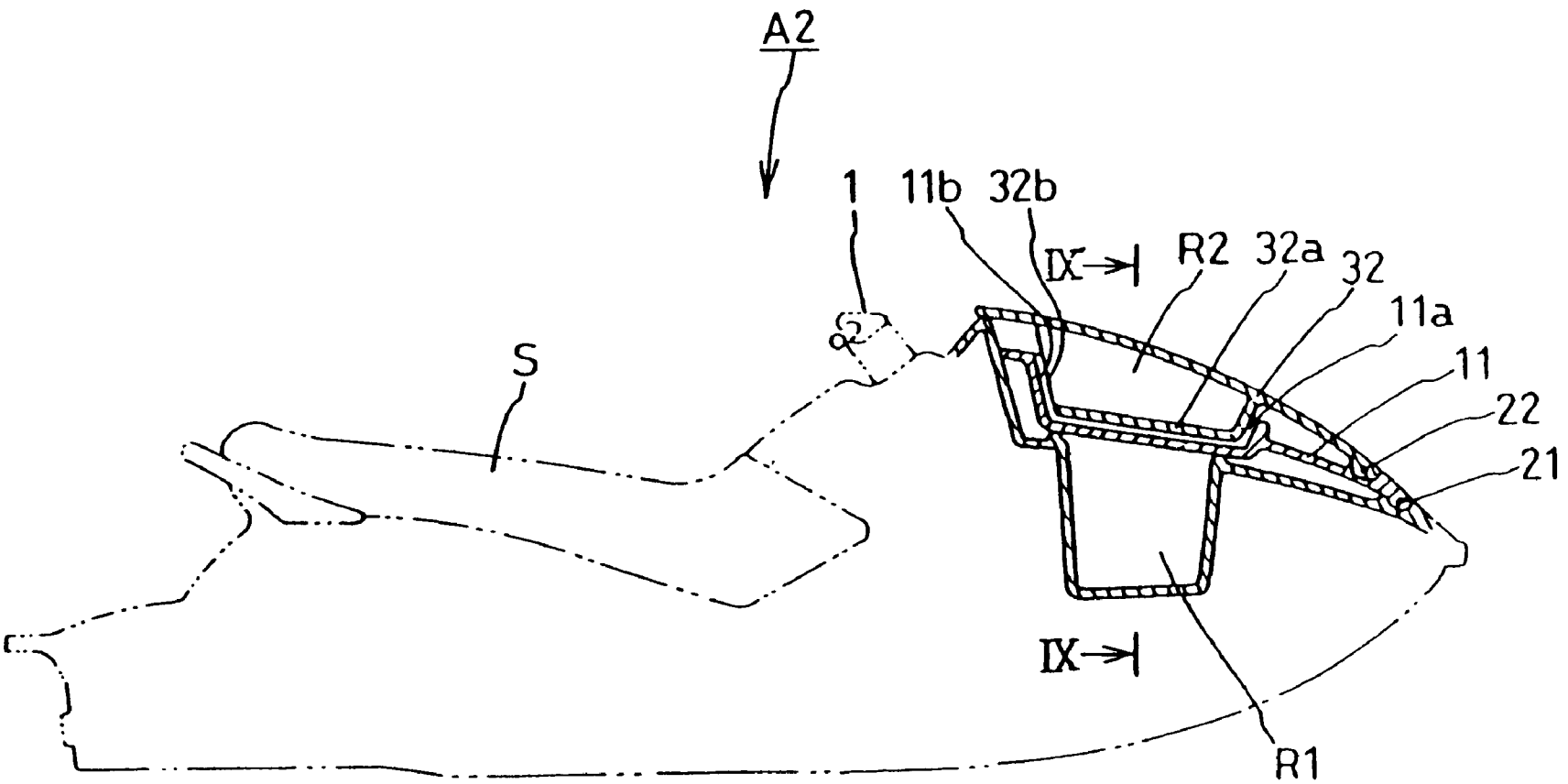
FIG. 8 is a cross sectional view of the front half portion of a deck and a first and second hatch covers, together with the contour lines of a personal watercraft as viewed from one side thereof, according to another preferred embodiment of the invention.
Figure 9:
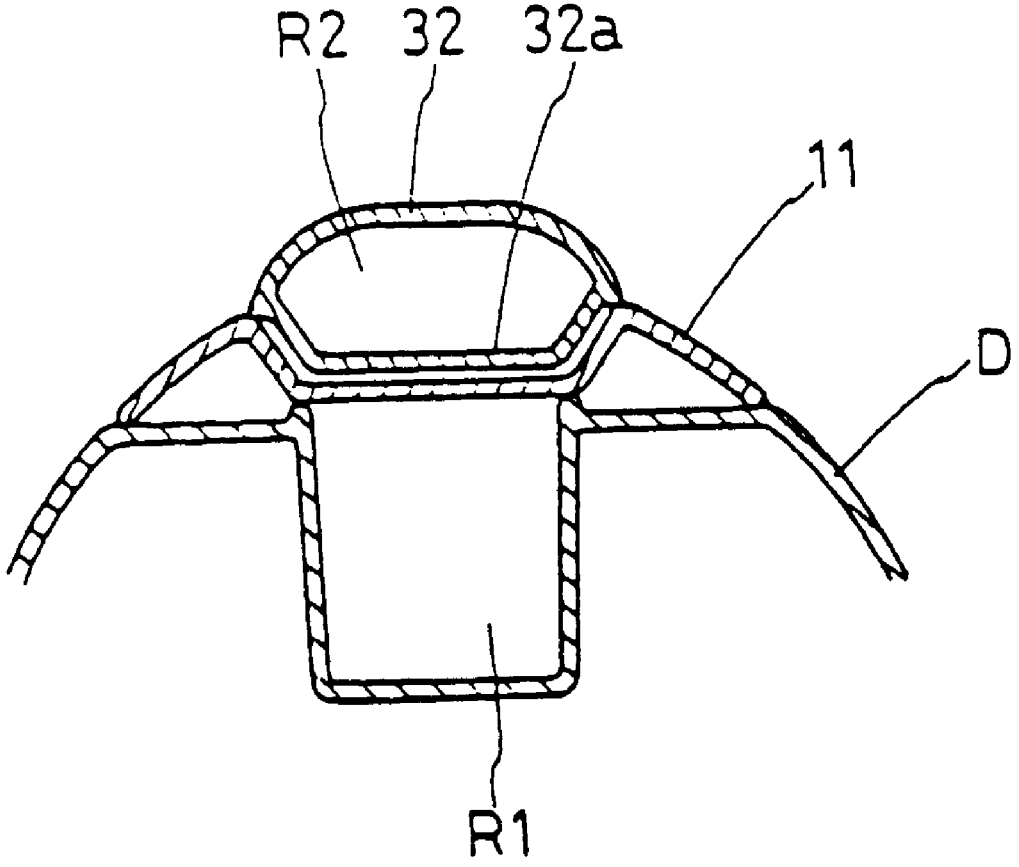
FIG. 9 is a cross sectional view taken along line IX—IX of FIG. 8.

Next, a storage structure according to another preferred embodiment of the invention will be described with reference to FIGS. 8 and 9. FIG. 8 is cross sectional area of the front half portion of the deck D and the first and second hatch covers 11 and 32, together with the contour lines of personal watercraft A2 as viewed from one side thereof. FIG. 9 is a cross sectional view taken along line IX—IX of FIG. 8. In this storage structure, as in the storage structure shown in FIGS. 1 to 7, the front end of the first hatch cover 11 is attached adjacent to the front end portion of the deck D by means of the shaft 21 so that the first hatch cover 11 can be opened and closed by being turned about the shaft 21. When the first hatch cover 11 is opened, the first storage area R1 is exposed. On the other hand, the front end of the second hatch cover 32 is attached adjacent to the front end portion of the first hatch cover 11 by means of the rotating shaft 22 so that the second hatch cover 32 can be opened and closed by being turned about the rotating shaft 22. When the second hatch cover 32 is opened, the second storage area R2 is exposed.

The storage structure of FIGS. 8 and 9 differs from the storage structure of FIGS. 1 to 7 in that a pocket 32*a* is formed inside the second hatch cover 32. The pocket 32*a* is of a shape and size that fits snugly into the recessed portion 11*a* formed in the upper surface of the first hatch cover 11. The open end 32*b* of the pocket 32*a* faces rearward so that the watercraft rider can take out articles from or put articles into the pocket 32*a* through this open end 32*b*. When the second hatch cover 32 is closed, the open end 32*b* of the pocket 32*a* is closed by a wall surface 11*b* of the recessed portion 11*a*. In this way, the wall surface 11*a* of the first hatch cover 11 also serves as the lid of the pocket 32*a*.

Numerous modifications and alternative embodiments of the invention will be apparent to those skilled in the art in view of the foregoing description. Accordingly, this description is to be construed as illustrative only, and is provided for the purpose of teaching those skilled in the art the best mode of carrying out the invention. The details of the structure and/or function may be varied substantially without departing from the spirit of the invention.

What is claimed is:

1. A storage structure for a personal watercraft having a handlebar for steering disposed in front of a seat of said watercraft, the storage structure comprising:

a first hatch cover installed in front of said handlebar in an openable and closable fashion with respect to a deck of said personal watercraft; and a second hatch cover installed on said first hatch cover in an openable and closable fashion with respect to said first hatch cover, wherein a first storage area is formed inside said first hatch cover, and a second storage area is formed inside said second hatch cover.

2. The storage structure according to claim 1, wherein a forward end of said first hatch cover is supported adjacent a forward end of said deck so that said first hatch cover is swingable with respect to said deck, and the forward end of said second hatch cover is supported adjacent the forward end of said first hatch cover so that said second hatch cover is swingable with respect to said first hatch cover.

3. The storage structure according to claim 1, wherein the forward end of said first hatch cover is supported on a first shaft about which said first hatch cover is swingable with respect to said deck, and the forward end of said second hatch cover is supported on a second shaft about which said second hatch cover is swingable with respect to said first hatch cover.

4. The storage structure according to claim 1, wherein said second storage area comprises a recessed portion formed in an upper surface of said first hatch cover.

5. The storage structure according to claim 1, wherein said second storage area comprises a pocket formed inside said second hatch cover.

6. The storage structure according to claim 1, wherein a recessed portion is formed in an upper surface of said first hatch cover, and said second storage area comprises a pocket capable of being accommodated within said recessed portion and formed inside said second hatch cover, and wherein an open end of said pocket is closed by a wall surface of said recessed portion when said second hatch cover is closed.

* * * * *